US006089385A

United States Patent [19]

Nozawa

[11] Patent Number: 6,089,385

[45] Date of Patent: Jul. 18, 2000

[54] ROLLER TYPE COMMODITY STAND

[75] Inventor: Toshio Nozawa, Tokyo, Japan

[73] Assignee: Enukanto Kabushiki Kaisha, Tokyo, Japan

[21] Appl. No.: 09/306,827

[22] Filed: May 7, 1999

[30] Foreign Application Priority Data

May 8, 1998 [JP] Japan ..... 10-142230

[51] Int. Cl.[7] ..... A47F 5/00

[52] U.S. Cl. ..... 211/59.2; 193/35 R

[58] Field of Search ..... 211/59.2, 151; 193/35 R; 312/42, 45

[56] References Cited

U.S. PATENT DOCUMENTS

| | | | |
|---|---|---|---|
| 2,593,089 | 4/1952 | Barry . | |
| 3,480,126 | 11/1969 | Jung . | |
| 4,765,493 | 8/1988 | Kinney | 211/59.2 |
| 5,115,920 | 5/1992 | Tipton et al. | 211/59.2 |
| 5,645,155 | 7/1997 | Houghton | 193/35 R |
| 5,788,090 | 8/1998 | Kajiwara | 211/59.2 |
| 5,951,228 | 9/1999 | Pfeiffer et al. | 211/151 X |

FOREIGN PATENT DOCUMENTS 8-024091 1/1996 Japan .

*Primary Examiner*—Robert W. Gibson, Jr.
*Attorney, Agent, or Firm*—Browdy and Neimark

[57] ABSTRACT

A roller type stand for the display and supply of commodities has an elongated base, an elongated slide case, and a large number of rollers attached to the slide case. A large number of concave portions for receiving mounting shafts of the rollers are formed to support walls of the slide case. Inwardly projecting ribs are integrally formed with side walls of the base as one piece. The support walls of the slide case are detachably inserted between the ribs and a bottom wall of the base, and upper sides of the mounting shafts are held by the ribs.

2 Claims, 2 Drawing Sheets

ROLLER TYPE COMMODITY STAND

BACKGROUND OF THE INVENTION

The present invention relates to a roller type stand for display and supply of commodities such as canned goods or bottled goods.

Previously, various kinds of commodities have been displayed in showcases of a convenience store or the like. The commodities are taken out by a purchaser or a store clerk initiating from a commodity placed on the front side of the showcase, and when the number of commodities has become small, the commodities are hidden from view by other commodities placed on both sides thereof. When supplying commodities to the showcase, the commodities left on the rear side of the showcase are first moved to the front side of the showcase, and next, commodities with new dates are arranged in an empty space on the rear side. This work is troublesome.

Japanese Laid-Open Patent Publication (Kokai) No. 8-24091 proposes a roller type stand which makes supply work of commodities easy. This roller type stand comprises a base (2) made of synthetic resin and a large number of rollers (3) attached to left and right walls (2*a*, 2*a*) of the base (2). As well shown in FIGS. 1 and 2 of the prior art, the rollers (3) are inclined as a whole so that the roller on the front side may be lower than the roller on the rear side. The commodities (S, S1, S2 . . . ) are aligned on the rollers (3) along a longitudinal direction thereof, and when a commodity (S1) on the front side is taken out, the following commodities (S2, S3 . . . ) slide forward by the own weight due to the inclination of the rollers (3). Therefore, the store clerk is required merely to place the supply commodities in the space produced on the rear side of the rollers (3).

The prior art roller type stand has such a problem that the assembly work is troublesome. When assembling it, first, a shaft (3*a*) of the roller (3) is rotatably supported by a concave portion (2*g*) formed in an upper surface of a lower side support member (2*e*) which is previously fixed to each of the left and right walls (2*a*, 2*a*), and then, an upper side support member (2*f*) is fixed to each of the left and right walls (2*a*, 2*a*) so that the shaft (3*a*) may not be separated from the concave portion (2*g*). This assembly work is troublesome. Furthermore, in the roller type stand assembled like this, the replacement of rollers is very difficult. Accordingly, even if a roller is broken in use or even if a roller with a poor performance in rotation is found after the assembling, it is not easy to deal with the problem.

In addition, the prior art roller type stand has such a problem that a good sliding movement of commodities cannot be obtained although it uses rotary rollers. The reason for this is that as shown in FIG. 4 of the prior art, in some cases, a commodity (s) runs onto the upper surface of the upper side support member (2*f*).

SUMMALY OF THE INVENTION

Accordingly, it is an object of the present invention to provide a roller type commodity stand whose assembling is easy.

Furthermore, it is another object of the present invention to provide a roller type commodity stand in which the replacement of rollers can very easily be performed.

Furthermore, it is another object of the present invention to provide a roller type commodity stand in which a smooth sliding movement of commodities can be obtained.

DESCRIPTION OF THE PREFERRED EMBODIMENT

Figures 1, 3:
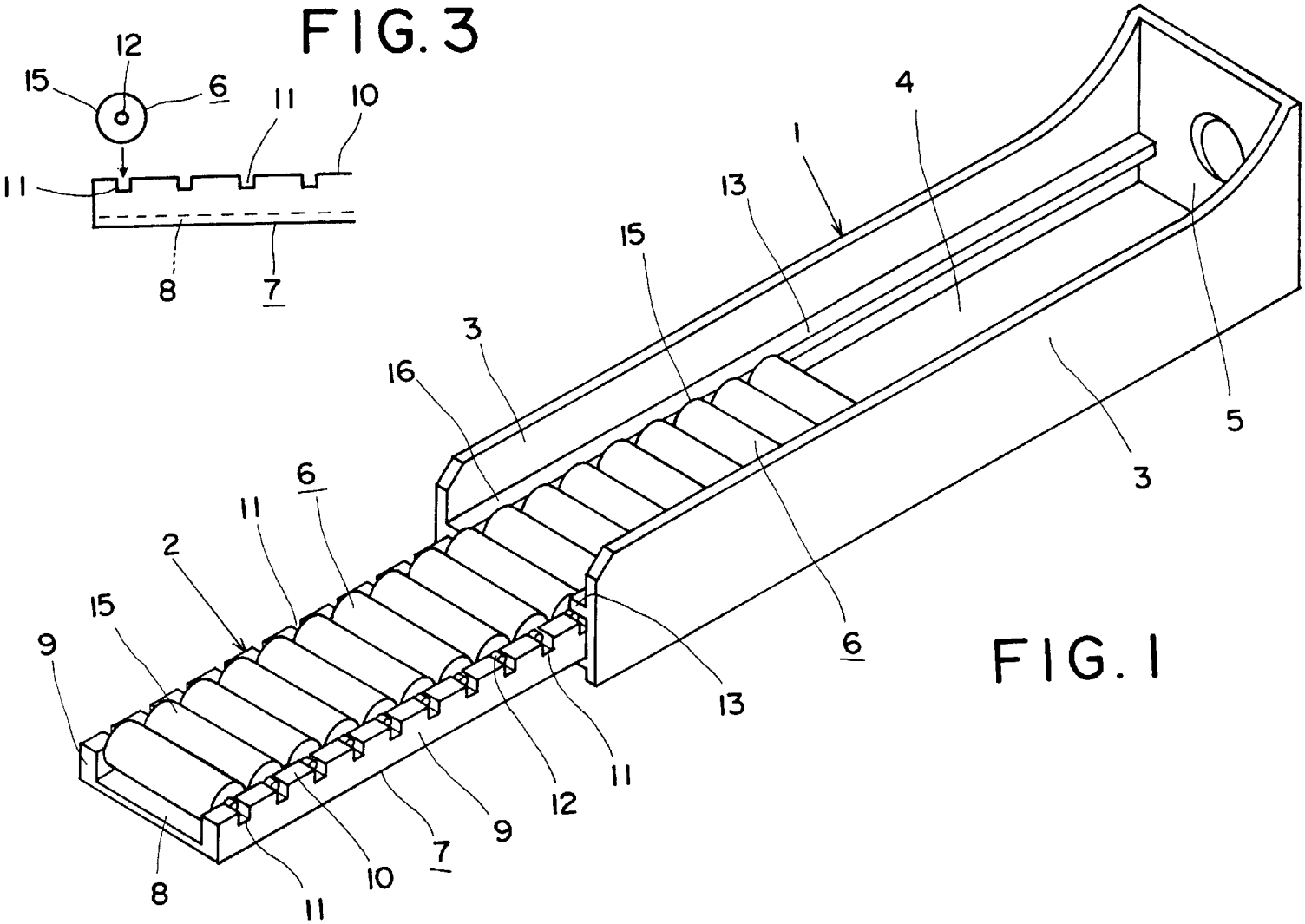
FIG. 1 is a perspective view of a roller type commodity stand according to the present invention.
FIG. 3 is a partial side view of the roller plate.
Figure 2:
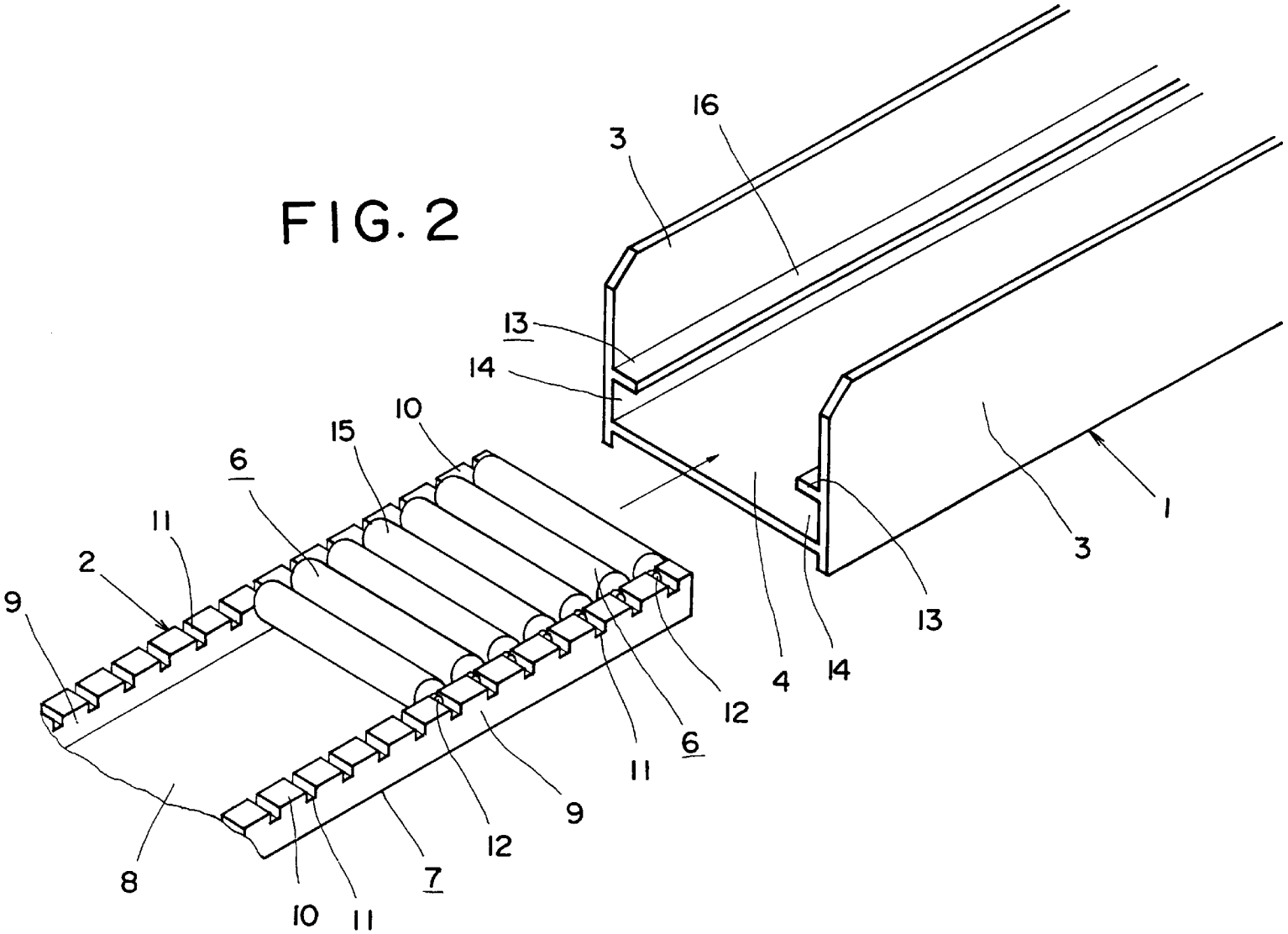
FIG. 2 is a perspective view showing a front portion of a base of the stand and a rear portion of a roller plate.

An embodiment of the present invention will be described by referring to drawings. A roller type stand according to the present invention comprises a base 1 made of synthetic resin and a roller plate 2 attached to the base 1. The base 1 includes left and right vertical side walls 3, 3, a horizontal bottom wall 4, and a vertical rear wall 5. It is suitable that the spacing between the side walls 3, 3 has a size sufficient to store commodities such as canned goods, bottled goods, paper-packed goods, or PET bottles.

The roller plate 2 comprises a large number of rollers 6 formed from polyacetal or the like and a slide case 7 to which the rollers 6 are attached. The slide case 7 includes a flat connecting wall 8 and comparatively low left and right support walls 9, 9 formed on both sides of the connecting wall 8. On an upper surface 10 of each of the support walls 9, 9, a large number of concave portions 11 are formed at constant intervals. Shafts 12, 12 on both sides of each of the rollers 6 are rotatably fitted in the concave portions 11, respectively. The shaft 12 stored in the concave portion 11 does not project upward out of the upper surface 10 of the support wall 9.

The side walls 3, 3 are integrally formed with horizontally and inwardly projecting ribs 13, 13 as one piece, so that grooves 14, 14 are defined between the ribs 13 and the bottom wall 4. When the support walls 9, 9 are inserted into the grooves 14, 14, the shafts 12 of the rollers 6 are covered by the ribs 13 so as to be prevented from coming out of the concave portions 11. Therefore, the assembling of the roller type stand according to the present invention is easier than that of a conventional one.

A top end of a cylindrical portion 15 of each of the rollers 6 is projected upward out of the upper surface 16 of each of the ribs 13.

The roller type stand according to the present invention is put on a display rack or shelf of a showcase in an inclined state. When the shelf is horizontal, a seating should be used to moderately incline the roller type stand. When a commodity on the foremost side among commodities put on the inclined roller type stand has been taken out by a purchaser or a store clerk, the following commodities slide forward while rotating the rollers 6 by the inclination. At this moment, the bottom surface of the following commodity comes into contact only with the cylindrical portions 15 of the rollers 6 projecting upward out of the upper surfaces 16 of the ribs 13, and therefore, the sliding resistance of the commodity is very small, and a good sliding movement can be expected.

The roller 6 can easily be removed only by pulling out the roller plate 2 forward relative to the base 1. Accordingly, the replacement of a broken roller or a defective roller is extremely easy.

What is claimed is:

1. A roller type stand for display and supply of commodities, comprising:

an elongated base including left and right side walls and a bottom wall connecting the side walls;

a roller plate including an elongated slide case and a large number of rollers attached to the slide case;

said slide case including a flat connecting wall and low left and right support walls formed on both sides of the connecting wall;

each of said rollers including mounting shafts on both sides thereof; and a large number of concave portions provided on an upper surface of each of the support walls at constant intervals and for respectively receiving the mounting shafts, each of said concave portions having an open upper portion thereof for receiving the mounting shaft;

wherein each of said side walls is integrally formed with a rib as one piece which is horizontally and inwardly projected, so that grooves are defined between the ribs and the bottom wall;

wherein said roller plate is attached to the base by slidably inserting the support walls into the grooves;

wherein an upper side of each of said mounting shafts is covered by the rib when said roller plate is attached to the base.

2. The roller type stand according to claim 1, wherein an upper portion of a cylindrical portion of each of said rollers is projected upwardly above an upper surface of each of the ribs.

* * * * *